US008764384B2

(12) United States Patent
Dullack et al.

(10) Patent No.: US 8,764,384 B2
(45) Date of Patent: Jul. 1, 2014

(54) JOINT FOR HOUSING ALIGNMENT

(75) Inventors: Kristian Norman Dullack, Torrance, CA (US); Harry Fuku Hess, Hermosa Beach, CA (US); Shawn Warren Merritt, Redondo Beach, CA (US)

(73) Assignee: Honeywell International Inc., Morristown, NJ (US)

( * ) Notice: Subject to any disclaimer, the term of this patent is extended or adjusted under 35 U.S.C. 154(b) by 804 days.

(21) Appl. No.: 12/970,713

(22) Filed: Dec. 16, 2010

(65) Prior Publication Data

US 2012/0151915 A1 Jun. 21, 2012

(51) Int. Cl.
*F02B 39/00* (2006.01)

(52) U.S. Cl.
USPC ..... 415/127; 415/214.1

(58) Field of Classification Search
USPC ..... 415/126, 127, 232
See application file for complete search history.

(56) References Cited

U.S. PATENT DOCUMENTS 4,181,466 A * 1/1980 Owen ..... 415/204

FOREIGN PATENT DOCUMENTS

JP 03286200 A * 12/1991

* cited by examiner

*Primary Examiner* — Richard Edgar
(74) *Attorney, Agent, or Firm* — Brian J. Pangrle

(57) ABSTRACT

An assembly kit includes a first turbocharger component flange with receptacles spaced according to a first interval angle; a second turbocharger component flange with receptacles spaced according to a second interval angle that differs from the first interval angle; and a piece configured for receipt by a receptacle of the first component and a receptacle of the second component where alignment of the receptacles determines a rotational orientation angle of the first component with respect to the second component. Various other examples of devices, assemblies, systems, methods, etc., are also disclosed.

18 Claims, 8 Drawing Sheets

JOINT FOR HOUSING ALIGNMENT

TECHNICAL FIELD

Subject matter disclosed herein relates generally to turbomachinery for internal combustion engines and, in particular, to housings.

BACKGROUND

Many conventional turbine systems include a housing that supports a shaft and another housing that houses a turbine wheel connected to the shaft. In turbochargers, the housing that supports the shaft is often referred to as a center housing as it is positioned between a compressor housing and a turbine housing. Conventional techniques for attaching a turbine housing to a center housing rely on a joint secured by a clamp with a circular shape. Such a clamp is usually flexible or expandable and may have a V-shaped cross-section that acts to force two components toward each other upon tensioning of the clamp. Sometimes a clamp with a V-shaped cross-section is referred to as a "v-band".

In practice, a v-band clamp can effectively join a turbine housing and a center housing axially. However, a v-band clamp may not sufficiently deter rotation of a turbine housing with respect to a center housing. Turbocharger field failures have been reported where the failure mode is turbine housing rotation relative to the center housing. Such rotation can stretch a turbine inlet bellows and eventually results in a cracked bellows and accompanying heavy exhaust leak. An exhaust leak has multiple consequences ranging from engine control, environmental control and hazards to occupants of a vehicle or other exposed to leaked exhaust.

As described herein, in various examples, equipment and techniques can help reduce risk of failures caused wholly or in part by rotation of a turbine housing relative to another housing.

BRIEF DESCRIPTION OF THE DRAWINGS

A more complete understanding of the various methods, devices, assemblies, systems, arrangements, etc., described herein, and equivalents thereof, may be had by reference to the following detailed description when taken in conjunction with examples shown in the accompanying drawings where.

DETAILED DESCRIPTION

Various examples presented herein pertain to two components where each component includes receptacles configured for receipt of a piece to constrain rotation (e.g., to limit or prevent rotation). A particular example includes a center housing with a series of holes and a turbine housing with a series of wells where the holes and the wells are configured for receipt of a pin. In such an example, a clamp (e.g., a v-band or other clamp) may be used to axially secure the housing with respect to each other. While the foregoing example mentions holes and wells, one or more of the components to be aligned may have holes, wells or a combination of holes and wells.

As described herein, receptacles may be arranged according to a type of vernier scale principle. Specifically, some receptacles may be fashioned with characteristics that differ from other receptacles such that two components can be arranged with respect to each other at any of a variety of rotational angles. Where a piece is inserted into two aligned receptacles, the piece may lock the components at that angle (e.g., depending on tolerances of fit, etc.). Such an approach can allow for more angles than the number of receptacles. For example, where one component includes 10 receptacles positioned at 11 degree intervals and another component includes 36 receptacles positioned at 10 degree intervals, the two components may be arranged at any of 360 angles from 0 degrees to 359 degrees.

Where a center housing and a turbine housing allow for many different orientations, with a mechanism to fix an orientation angle, components may be shipped from an assembly plant in a single orientation and re-oriented and adjusted at a client's convenience to fit any particular specific end use application, mount location, or mount stack-up variation. Along a product distribution chain, it can be desirable to have a single turbocharger part number (P/N) capable of various angular orientations with features for fine incremental angular adjustment.

Various examples described herein refer to a pin installed in a joint that acts to mechanically stop relative rotation between a center housing and an end housing. Various examples pertain to a series of vernier scale type receptacles located in both housings that allow for angular adjustment in fine increments. Various approaches described herein allow for a pinned joint anti-rotation feature to be used where the end-use orientation may be unknown.

The examples described herein may be suitably modified, for example, by changing receptacle count or angular locations in the parts. Such modifications may act to change incremental adjustment size, to allow the use of multiple pins, to reverse the rotation direction for an end housing, etc.

Figure 1:
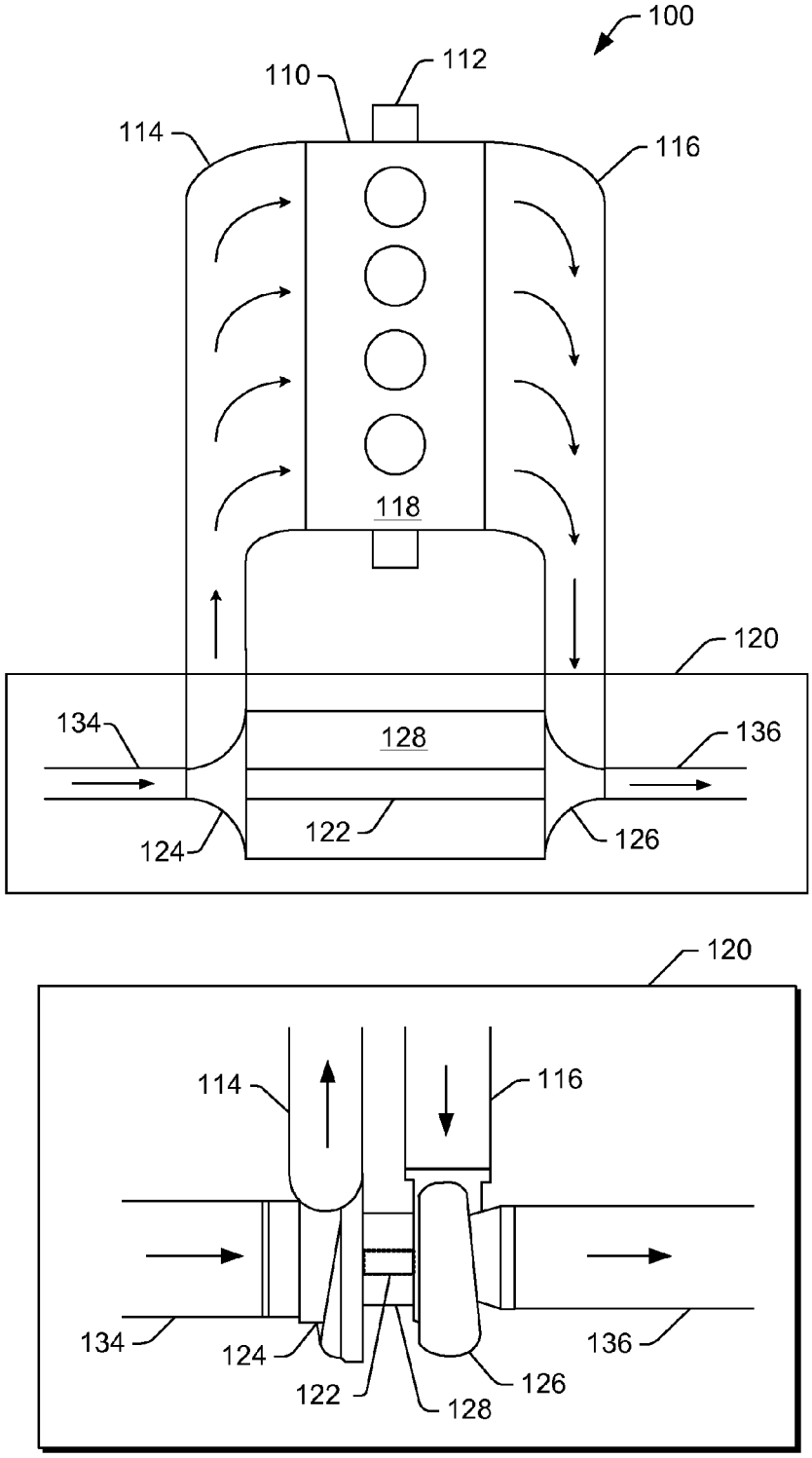
FIG. 1 is a diagram of a turbocharger and an internal combustion engine.

Turbochargers are frequently utilized to increase output of an internal combustion engine. Referring to FIG. 1, a conventional system 100 includes an internal combustion engine 110 and a turbocharger 120. The internal combustion engine 110 includes an engine block and head assembly 118 housing one or more combustion chambers that operatively drive a shaft 112. As shown in FIG. 1, an intake port 114 provides a flow path for air to the engine block and head assembly 118 while an exhaust port 116 provides a flow path for exhaust from the engine block and head assembly 118.

The turbocharger 120 acts to extract energy from the exhaust and to provide energy to intake air, which may be combined with fuel to form combustion gas. As shown in FIG. 1, the turbocharger 120 includes an air inlet 134, a shaft 122, a compressor 124, a turbine 126, a housing 128 and an exhaust outlet 136. The housing 128 may be referred to as a center housing as it is disposed between the compressor 124 and the turbine 126. The shaft 122 may be a shaft assembly that includes a variety of components.

As described herein, a turbocharger may include a variable geometry compressor, a variable geometry turbine, an internal wastegate or other features. Such features may rely on one or more control mechanisms. For example, a wastegate may be operated according to a control signal from an engine control unit (ECU) or other controller. Various examples presented herein may be suitably configured for use with variable geometry mechanisms, wastegate mechanism or other mechanisms. For example, fine incremental control of an angle between two components may be adjusted to more effectively align a control mechanism or one or more associated features.

Figure 2:
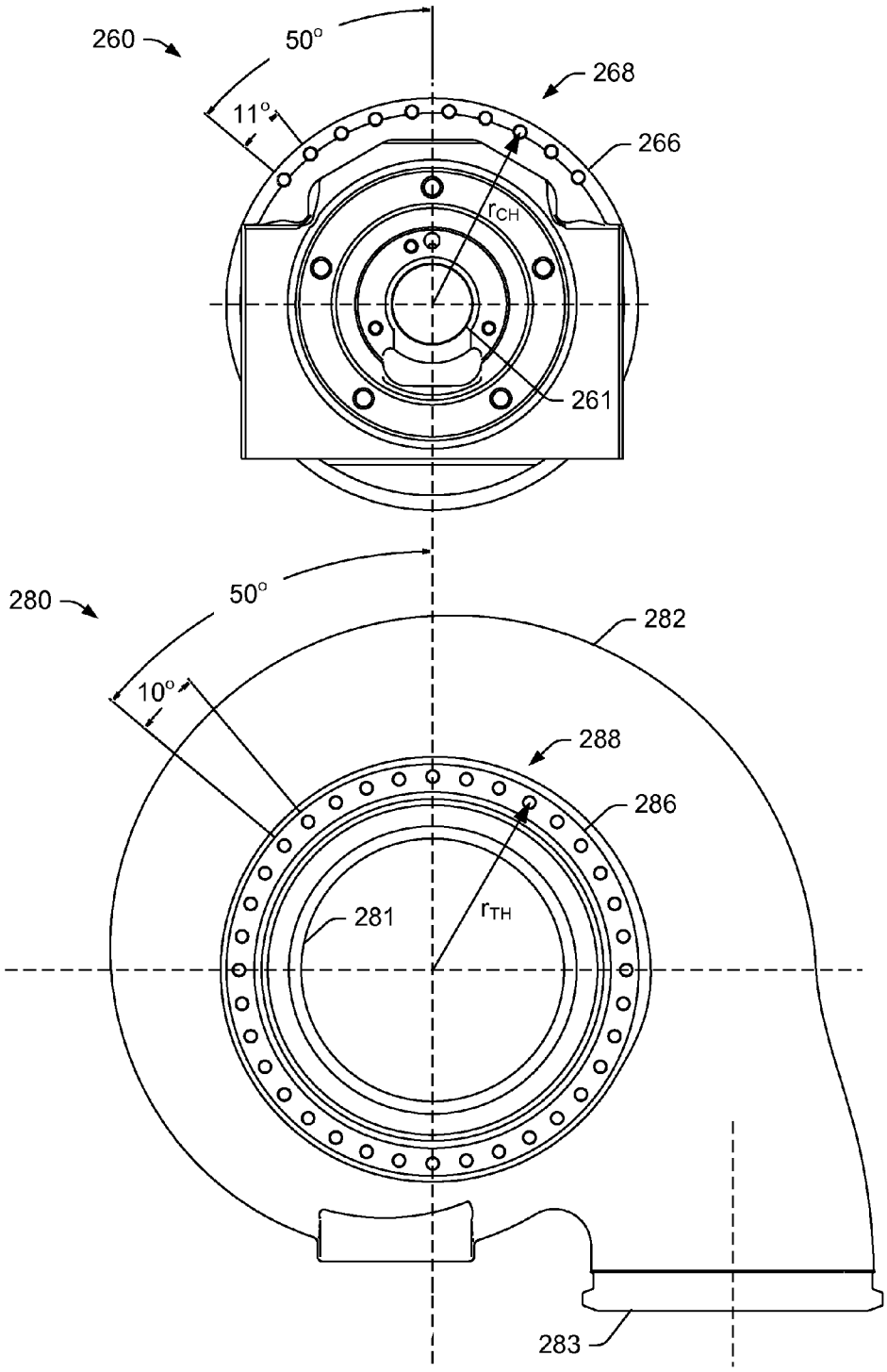
FIG. 2 is an end view of an example of a center housing and an end view of an example of a turbine housing.

FIG. 2 shows an end view of an example of a center housing 260 and an end view of an example of a turbine housing 280. The center housing 260 includes a bore 261 and a flange 266 with a series of holes 268. In the example of FIG. 2, ten holes are disposed along an arc at a radius $r_{CH}$ spanning 99 degrees at equal intervals of eleven degrees (e.g., 10 holes with 11 degree spacing provides for 9 equal spaces at 11 degrees per space).

The turbine housing 280 includes a bore 281 configured for receipt of a turbine wheel, a volute 282 and an exhaust inlet 283 where exhaust can enter the inlet 283 and be directed by the volute 282 to a turbine wheel in the bore 281. In the example of FIG. 2, thirty-six wells are disposed about 360 degrees at a radius of $r_{TH}$ at equal intervals of ten degrees (e.g., to provide 36 equal spaces as a space exists between the first and last wells). The example of FIG. 2 also shows the inlet 283 being configured at an angle (e.g., measurable from one of coordinate axes). While the example of FIG. 2 refers to "holes" and "wells", the components 260 and 280 may include holes, wells or a combination of holes and wells. Such features may be referred to as receptacles and depend on particularities of a piece relied on to mechanically deter or constrain rotation (e.g., an anti-rotation piece). For example, a pin may be configured for receipt by two holes, a hole and a well or two wells. In another example, a clip may be relied on and inserted through two holes. More specifically, where a pair of aligned holes are used, a piece may be configured for insertion or removal in a manner that does not necessarily require separation of two housings.

Figure 3:
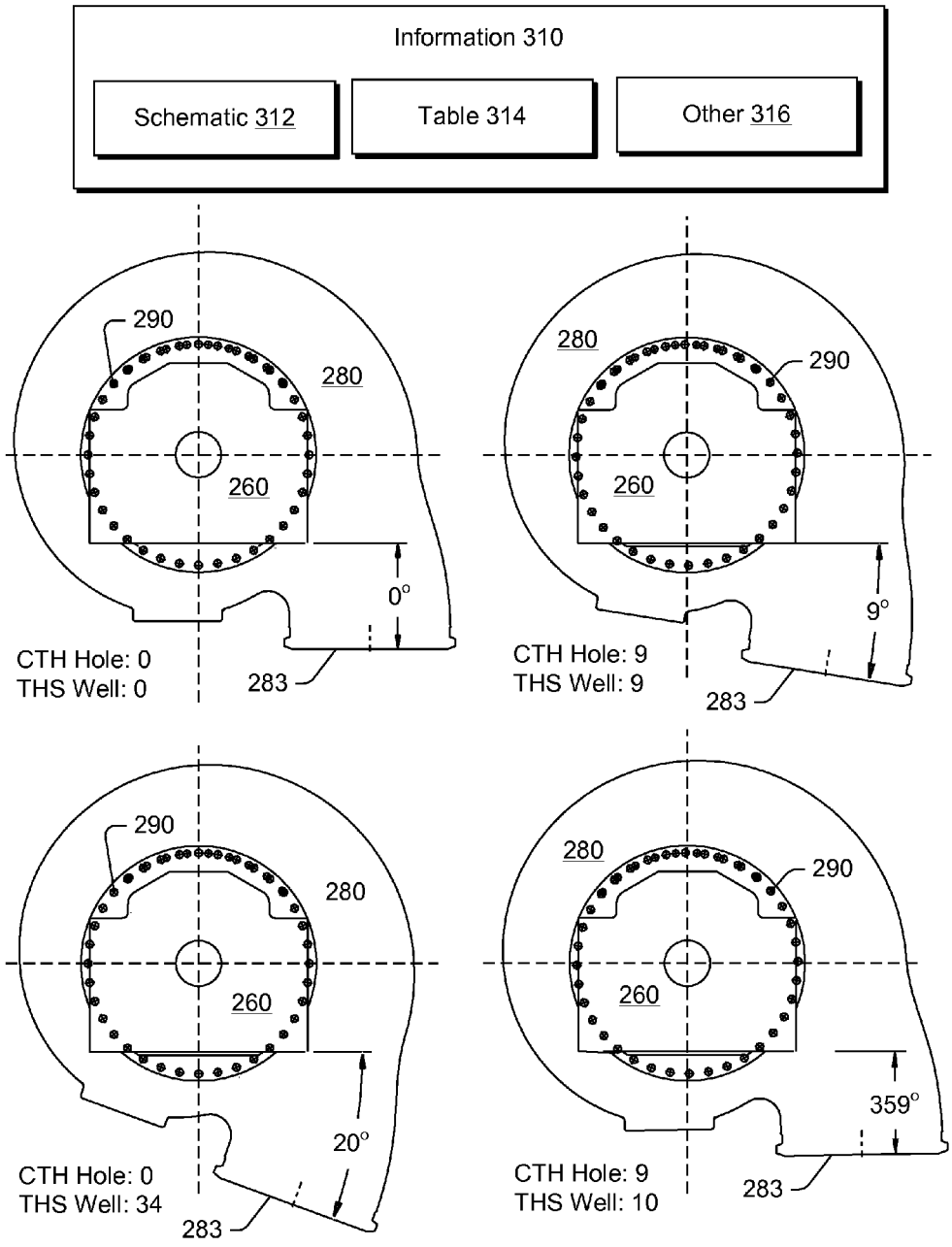
FIG. 3 is a series of views of examples of arrangements of a center housing with respect to a turbine housing along with forms of optional information pertaining to achieving arrangements.

FIG. 3 shows a series of views of examples of arrangements of the center housing 260 with respect to the turbine housing 280 along with some examples of forms of information 310. The particular examples are for angles of zero degrees, nine degrees, twenty degrees and three-hundred and fifty-nine degrees. For zero degrees, a pin 290 is inserted into center housing hole 0 and turbine housing well 0; for nine degrees, a pin 290 is inserted into center housing hole 9 and turbine housing well 9; for twenty degrees, a pin 290 is inserted into center housing hole 0 and turbine housing well 34; and, for three-hundred and fifty-nine degrees, a pin 290 is inserted into center housing hole 9 and turbine housing well 10. In the example of FIG. 3, angles from zero degrees to three-hundred and fifty-nine degrees can be achieved. Information 310 pertaining to these various arrangements may be provided as a schematic 312, a table 314, or other (e.g., electronically readable format such as a processor-readable storage medium, a computer-readable storage medium, etc.).

Figure 4:
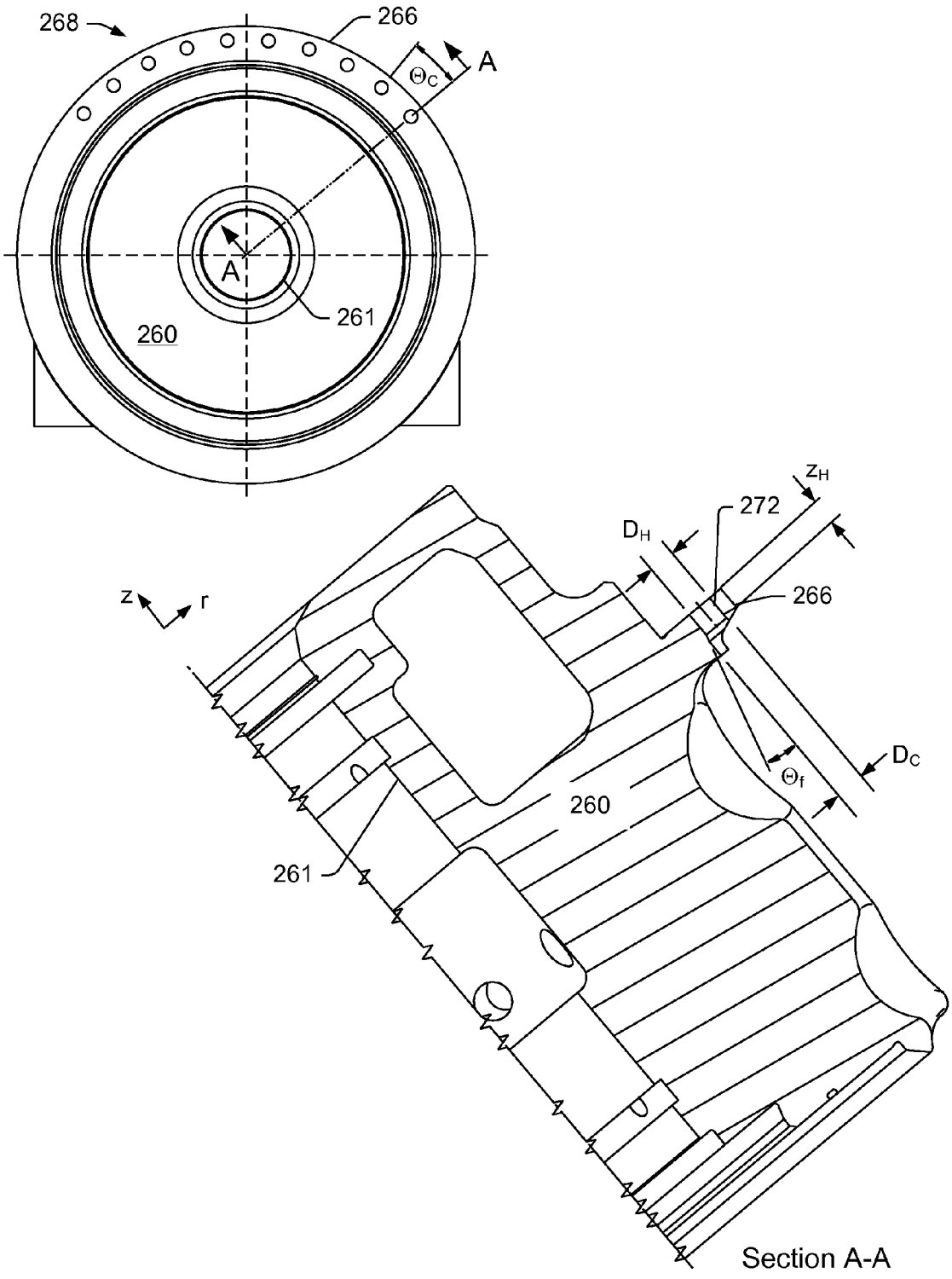
FIG. 4 is an end view and a cross-sectional view of an example of a center housing.

FIG. 4 shows an end view and a cross-sectional view of an example of a center housing 260 with a through bore 261 configured for receipt of a bearing to support a shaft. The end view shows a series of receptacles disposed about a radius separated by intervals of angle $\Theta_c$. The cross-sectional view along a line A-A shows various features associated with a hole 272. As indicated, the hole 272 is a through hole in a flange 266 of the housing 260. The hole 272 includes diameter $D_H$ and a length $z_H$ that extends from a joint side to an outer side of the housing 260. In the example of FIG. 4, the hole 272 includes a chamfered diameter $D_C$ at the outer side having a chamfer angle $\Theta_f$.

Figure 5:
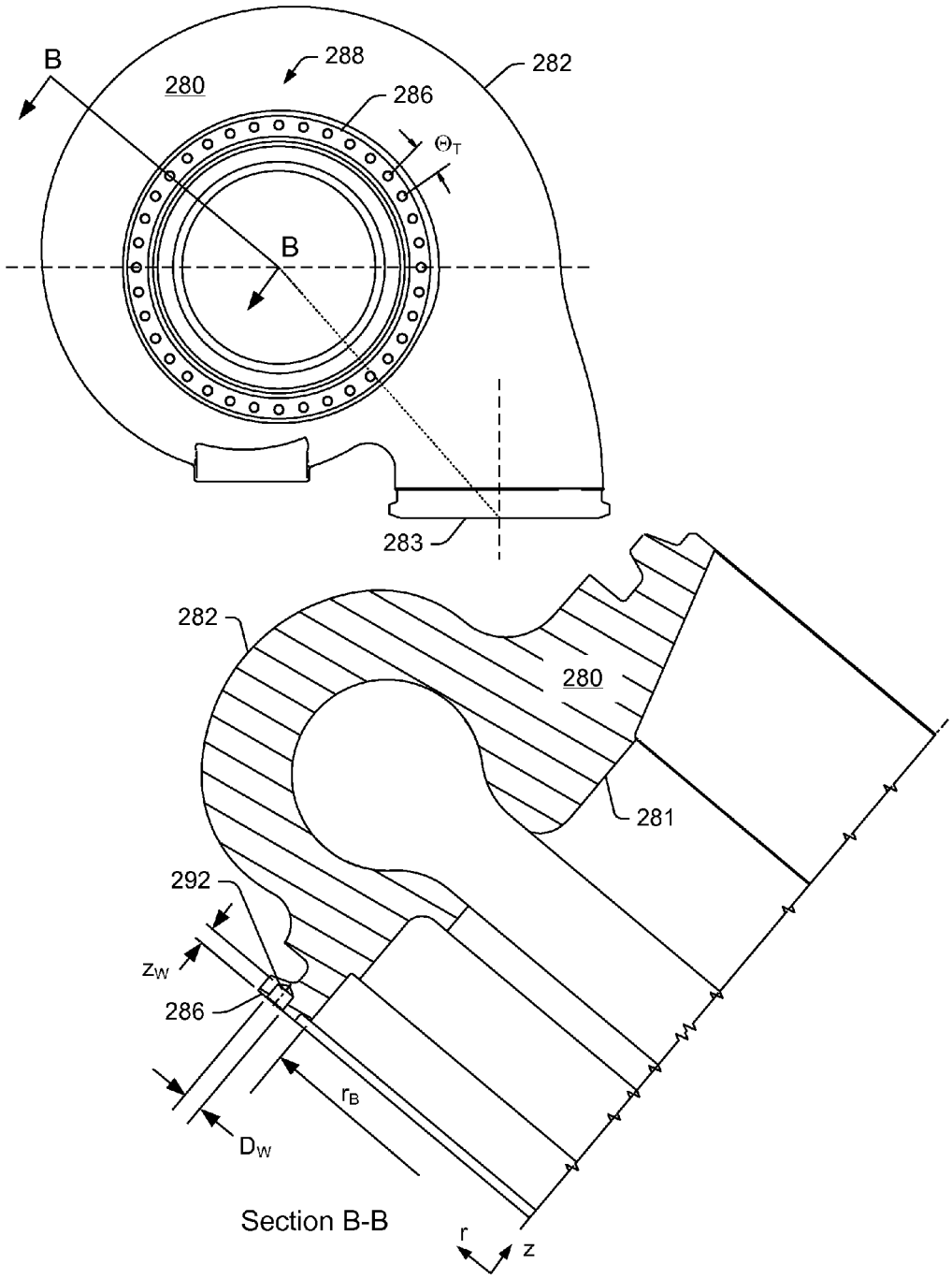
FIG. 5 is an end view and a cross-sectional view of an example of a turbine housing.

FIG. 5 shows an end view and a cross-sectional view of an example of a turbine housing 280 with a through bore 281 configured for receipt of a turbine wheel supported by a shaft. The end view shows a series of receptacles disposed about a radius separated by intervals of angle $\Theta_T$. The cross-sectional view along a line B-B shows various features associated with a well 292. As indicated, the well 292 is in a flange 286 of the housing 280. The well 292 includes diameter $D_W$ and a length $z_W$ that extends from a joint side into the flange 286 of the housing 280. In the example of FIG. 5, the well 292 includes a end shape that may allow for achieving a suitable well depth without penetrating an opposing side of the flange 286 (e.g., an angle that matches or approximates a surface angle of the housing 280).

Figure 6:
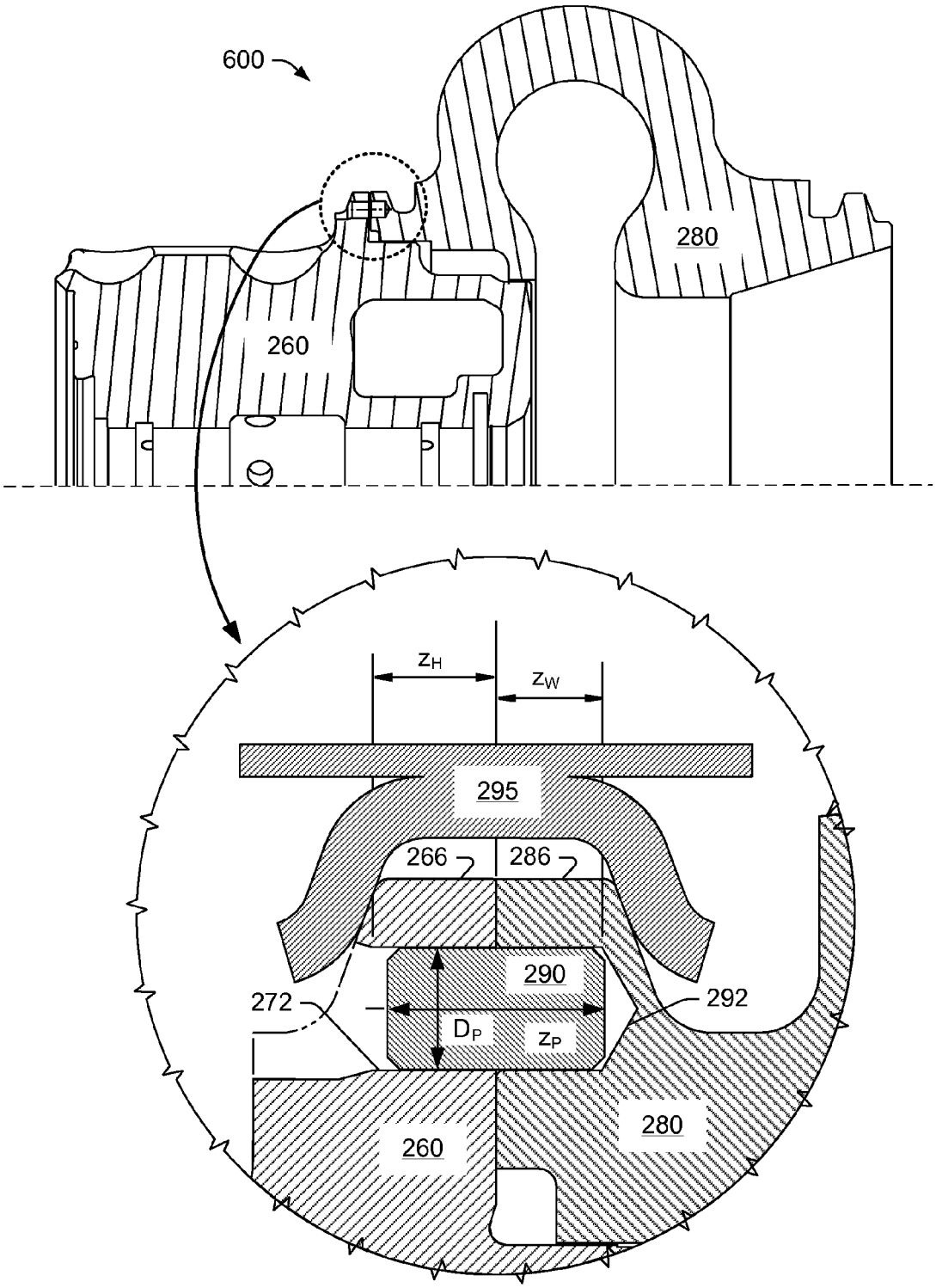
FIG. 6 is a cross-sectional view of an example of an assembly with a pin that acts to prevent rotation of components.

FIG. 6 shows a cross-sectional view of an example of an assembly 600 that includes a pin 290 that acts to prevent relative rotation of components 260 and 280. In an enlarged cross-sectional view, the assembly 600 further includes a clamp 295, which has angled surfaces that act to apply force to the components 260 and 280 at the joint formed by the flanges 266 and 286. Such a clamp may be a v-band clamp. A clamp may be configured with a mechanism that allows for adjusting a diameter or other dimension of the clamp (e.g., a larger diameter for placement and smaller diameter for securing).

As shown, the pin 290 has a pin diameter $D_P$ and a pin length $Z_P$. The pin 290 is received by both the hole 272 of the housing 260 and the well 292 of the housing 280. The clamp 295 acts to axially locate the housing 260 with respect to the housing 280 along respective outer surfaces of the flanges 266 and 286 while the pin 290 acts to limit an orientation angle of the housing 260 with respect to the housing 280 along inner surfaces of the flanges 266 and 286, as defined by their respective receptacles 272 and 292. As described herein, the function of a pin or other piece may be to constrain the clocking angle, to radially locate a housing with respect to another housing, to constrain and radially locate, etc.

Figure 7:
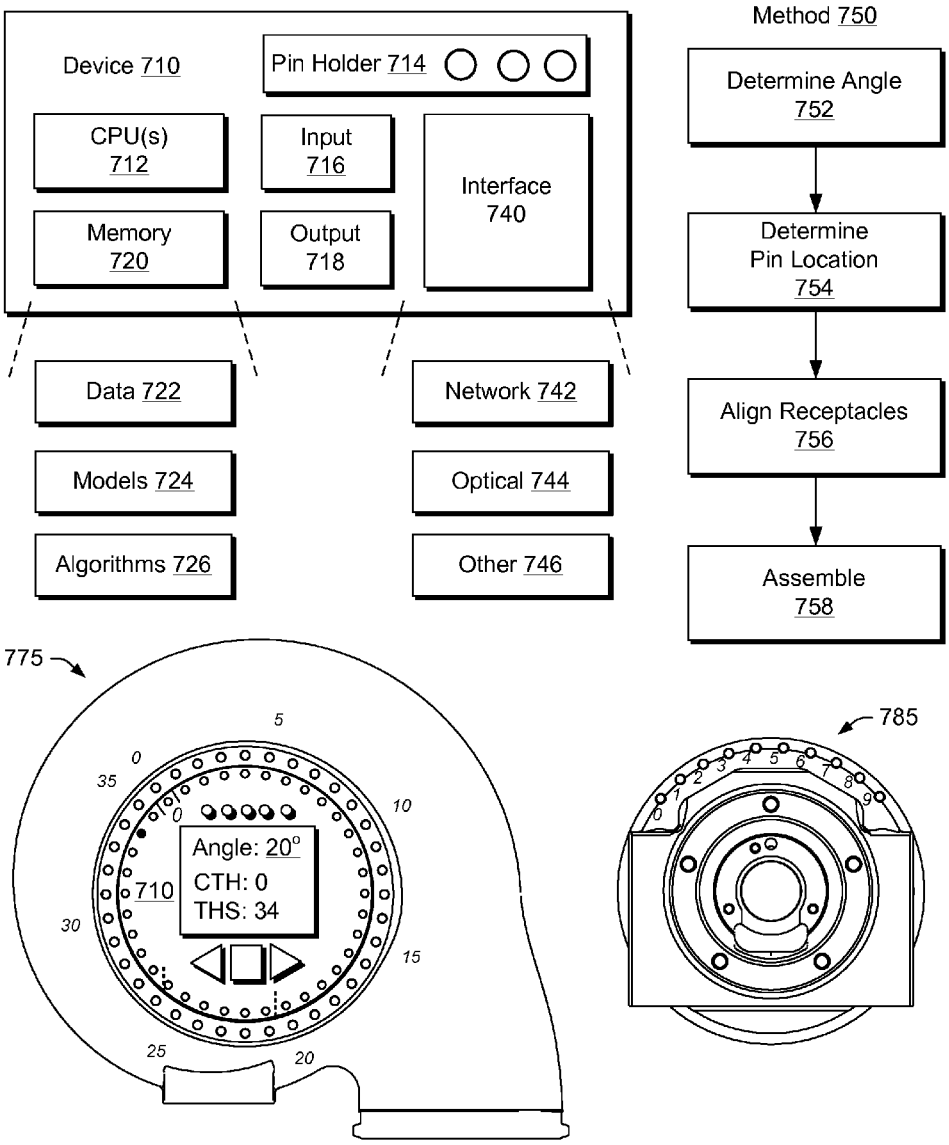
FIG. 7 is a block diagram of an example of a device and an example of a method along with examples of housings.

FIG. 7 shows a block diagram of an example of a device 710 and an example of a method 750 along with examples of housings 775 and 785. In the example of FIG. 7, the device 710 includes one or more CPUs (or cores) for processing instructions, which may be stored on one or more processor-readable medium (e.g., memory 720). The device 710 is also shown as including an optional pin holder 714, an input block 716, an output block 718 and an interface 740.

The memory 720 of the device 710 may be removable, fixed or a combination of removable and fixed. The memory 720 may include information such as data 722, model information 724, algorithms 726, etc. For example, data 722 may be a table of receptacle information to achieve various angles, model information 724 may be information about housing models, application models (e.g., engines, vehicles, etc.), and algorithms 726 may be one or more algorithms that can determine at least one receptacle for positioning of a piece. The interface 740 of the device 710 may be a network interface 742, an optical interface 744 or other type of interface 746. As described herein, an optical interface may be configured to determine an angle based on an optical measurement (e.g., LED, laser, detector, etc.).

In the example of FIG. 7, the method 750 includes a determination block 752 for determining an angle, a determination block 754 for determining a pin location (e.g., an anti-rotation piece location), an alignment block 756 for aligning receptacles, and an assembly block 758 for assembling two or more components. The method 750 is provided an example; noting that other methods of assembly may be used (e.g., determining pin location by visual inspection upon alignment of receptacles, etc.). Further, in various examples, aligning results in misaligning of other receptacles. For example, in FIG. 3, upon alignment of receptacles for receipt of the pin 290, other receptacles of the housing 260 are misaligned with respect to other receptacles of the housing 280.

The example housing 775 is shown in FIG. 7 in conjunction with an arrangement of the device 710. As shown, the housing 775 may include indicia to readily locate receptacles (e.g., numbered from 0 to 35). The device 710 may be configured for alignment with a bore of the housing 775 and with a display (e.g., LCD, LED or other) and input features that allow for identification of a particular receptacle. For example, an angle of twenty degrees may correspond to housing holes of 0 and 34. The example housing 785 has fewer receptacles than the housing 775 and these may be numbered as indicated from 0 to 9.

As described herein, a cradle, jig or other fixture may be supplied for aligning two components at a particular angle. For example, a fixture may be configured to hold two components at a predetermined set angle. With the components held by the fixture, one or more aligned receptacles may be determined by visual inspection and a piece inserted into at least one of the aligned receptacles to constrain rotation.

As described herein, a component or components may include one or more redundant receptacles. For example, the housing 785 of FIG. 7 may include an additional set of receptacles. In such an example, a piece may be placed in one of two or more aligned receptacles. In such an example, more than one piece may be provided such that two or more pieces can be placed in two or more aligned receptacles. As described herein, a piece or pieces may limit or constrain rotation of one component with respect to another component and optionally clamp the components axially. For example, a piece may be provided as a bolt with a nut where the bolt can be inserted into two aligned holes. In another example, a well may be a threaded well configured to receive a threaded bolt. As described herein, a piece may be, or include, a pin, a bolt, a wire, a spring, a quick release feature, etc.

With respect to redundancy, redundant features may allow for use of more than one pin or other type of piece for strength, or to allow redundant aligned locations for a single pin to be inserted to allow for blocked access to one or more series of receptacles (e.g., due to a controller arrangement, a heat shield, pipe configuration, etc.).

As described herein a v-band clamp or other type of clamp may include one or more rims configured to cover a pin or other type of piece inserted into aligned receptacles. In such a manner, the clamp ensures that the pin or other type of piece remains inserted during shipping, movement or operation of an assembly. As described herein, an assembly may be packaged with a particular orientation angle with a clamp and then reoriented by loosening or removal of the clamp, rotating, reinserting a piece in aligned receptacles and reclamping.

As described herein, two components may be joined, for example, via one or more clamps or one or more other mechanisms. A clamp may by a v-band or other type of clamp. A clamp may rely on bolts, for example, two components may be joined via a bolted joint with clamps spanning between bolts. As an example, consider a center housing with a 9 degree interval for 40 receptacles such that alignment is achieved at four of the receptacles to allow for placement of two or more bolts and optionally one or more clamps spanning between two or more bolts.

As described herein, orientation may be clockwise or counterclockwise. One or more components may include markings for clockwise or counterclockwise orientation angles (e.g., depending on a viewing side, etc.). In the example of FIG. 3, an 11 degree interval corresponds to a clockwise rotation; in another example, a 9 degree interval corresponds to a counterclockwise rotation. Intervals or gaps may be used on one or more components to space a pinning location (e.g., optionally to avoid having receptacles in a compact area).

Figure 8:
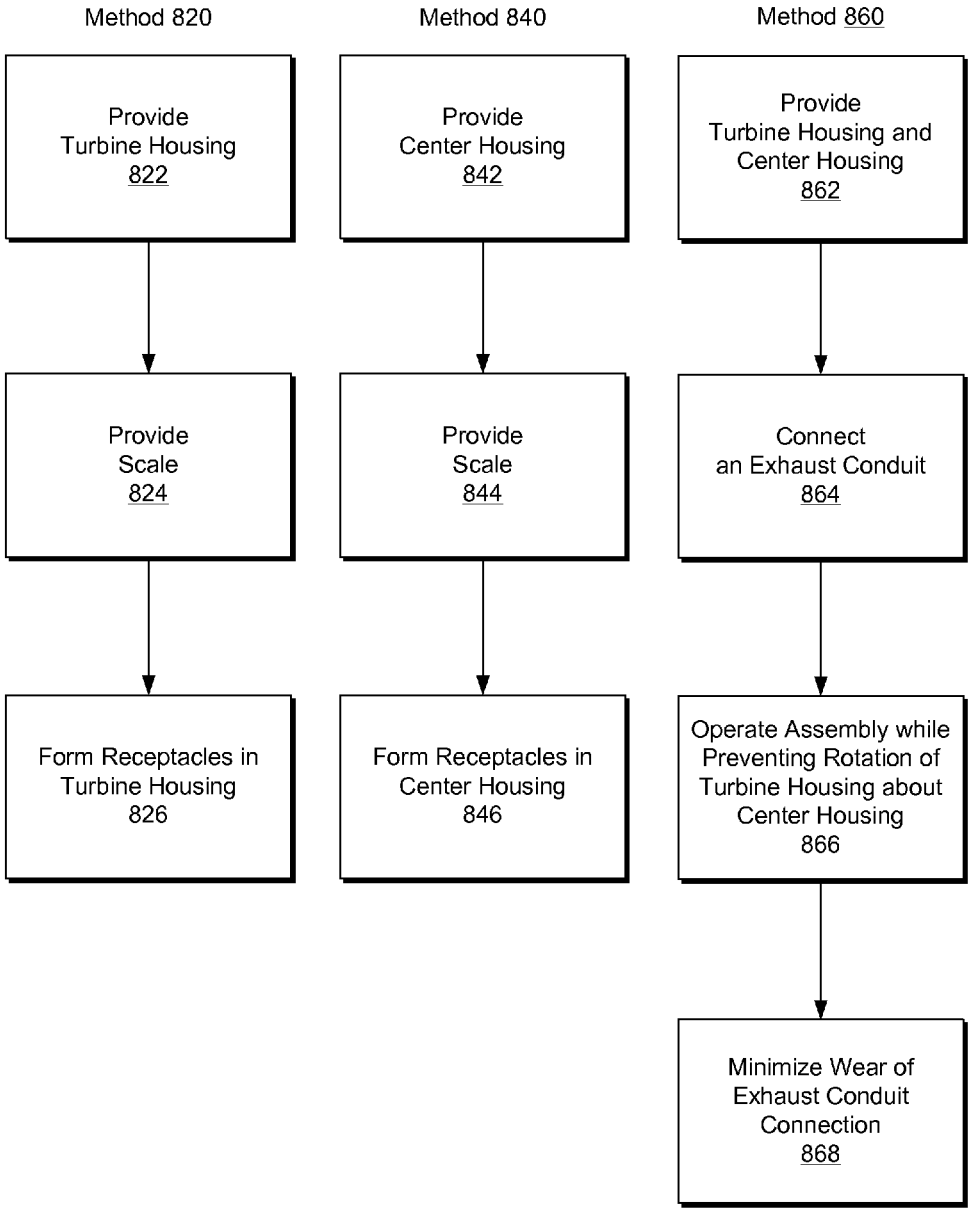
FIG. 8 is a block diagram of examples of methods.

FIG. 8 is a block diagram of examples of methods 820, 840 and 860. The method 820 includes a provision block 822 for providing a turbine housing, a provision block 824 for providing a scale and a formation block 826 for forming receptacles in the turbine housing. The method 840 includes a provision block 842 for providing a center housing, a provision block 844 for providing a scale and a formation block 846 for forming receptacles in the center housing.

The method 860 includes a provision block 862 for providing a turbine housing and a center housing, a connection block 864 for connecting an exhaust conduit to the turbine housing, an operation block 866 for operating an assembly that include the turbine housing and the center housing while preventing rotation of the turbine housing about the center housing, and a minimization block 868 for minimizing wear of the exhaust conduit connection. While FIG. 8 refers to a turbine housing, a compressor housing may include receptacles that can align with receptacles of a center housing (e.g., according to a vernier scale approach) to allow for orientation of the housings, for example, to optionally minimize wear of a conduit or conduits attached to the compressor housing.

As described herein, an assembly kit can include a first turbocharger component flange that includes receptacles spaced according to a first interval angle; a second turbocharger component flange that includes receptacles spaced according to a second interval angle that differs from the first interval angle; and a piece configured for receipt by a receptacle of the first component and a receptacle of the second component where alignment of the receptacles determines a rotational orientation angle of the first component with respect to the second component. In such an example, the receptacles of the first component or the second component may be holes, wells, a combination of holes and wells or one or more other types of receptacles.

As described herein, an assembly kit may include information such as an information table with rotational orientation angles and receptacle locations to achieve each of the rotational orientation angles. As mentioned, such information may be stored in a processor-readable medium, a computer-readable medium, etc.

In various examples, an assembly or assembly kit may include a component with an interval angle that exceeds the interval angle of a second component. Where differing interval angles are desired, the component with the larger interval angle or the smaller interval angle may be selected based on one or more factors (e.g., number of receptacles, joint surface size, joint surface location, joint surface or flange integrity, etc.). Similarly, number of receptacles for each component may be determined according to one or more factors. In various examples, a component with a larger interval angle has fewer receptacles than a conjoining component with a smaller interval angle.

While various examples pertain to an assembly that provides for incremental rotational orientation angles of one degree, with a suitable reduction in number of receptacles, an assembly or assembly kit may be configured for incremental rotational orientation angles of less than approximately ten degrees or other number of degrees. Similarly, depending on any of a variety of factors, an assembly may be configured for rotational orientation angles ranging from zero degrees to three-hundred and fifty-nine degrees or one or more other ranges. For example, one or more components may be configured for orientation angles ranging from zero to ninety degrees, zero to one-hundred and eighty degrees, or other range or ranges of degrees. As described herein, one or more components may be configured for orientation angles of non-contiguous ranges. For example, one or more components may be configured for ranges of zero to ninety degrees and from one-hundred and eighty degrees to two-hundred and seventy degrees.

As described herein, an assembly can include a center housing that includes a joint surface with a first number of receptacles; a turbine housing or a compressor housing (e.g., an end housing) that includes an opening configured for gas flow (e.g., an exhaust inlet or a compressed air outlet) and a joint surface with a second number of receptacles that differs from the first number of receptacles; and a pin selectively positioned at least partially in one of the receptacles of the center housing and at least partially in one of the receptacles of the turbine housing or compressor housing to constrain rotation of the housing opening configured for gas flow with respect to the center housing. In such an assembly, an exhaust conduit may be connected to the exhaust inlet of the turbine housing or a compressed air conduit may be connected to the compressed air outlet of the compressor housing. For example, with the pin located, constraint of rotation acts to avoid wear of the exhaust conduit or wear of the compressed air conduit, which can be advantageous where a conduit may include a bellows that may be particularly sensitive to misalignment of a housing and a center housing.

As described herein, a method can include providing a center housing that includes a joint surface with receptacles; providing a turbine housing or a compressor housing (e.g., an end housing) that includes a joint surface with receptacles; aligning one of the receptacles of the center housing with one of the receptacles of the end housing (e.g., where the aligning misaligns all or some of the other receptacles); and inserting a piece into the aligned receptacles. Such a method may include determining a location for the piece prior to the aligning wherein the determining determines a rotational orientation angle for the end housing with respect to the center housing.

As described herein, a center housing may include features for angular orientation of a turbine housing and features for angular orientation of a compressor housing where one or more of the turbine housing and the compressor housing optionally include complementary features. As described herein, a rotational orientation angle may be about a common axis of two or more components. For example, a turbine housing may have a bore that defines an axis for a turbine wheel while a center housing may have a bore that defines an axis for a shaft attached to the turbine wheel. Similarly, a compressor housing may have a bore that defines an axis for a compressor wheel. A center housing may be configured for orientation with respect to gravity, for example, for purposes of lubricant. Orientation of a center housing with respect to gravity may define a zero degrees orientation while an exhaust inlet of a turbine housing (e.g., inlet to a volute) or a compressed air outlet of a compressor housing (e.g., outlet from a volute) may define the rotational orientation angle with respect to the defined zero degree angle of the center housing.

Although some examples of methods, devices, systems, arrangements, etc., have been illustrated in the accompanying Drawings and described in the foregoing Detailed Description, it will be understood that the example embodiments disclosed are not limiting, but are capable of numerous rearrangements, modifications and substitutions without departing from the spirit set forth and defined by the following claims.

What is claimed is:

1. An assembly kit comprising:

a first turbocharger component flange that comprises receptacles spaced according to a first interval angle;

a second turbocharger component flange that comprises receptacles spaced according to a second interval angle that differs from the first interval angle; and a piece configured for receipt by a receptacle of the first component and a receptacle of the second component wherein alignment of the receptacles determines a rotational orientation angle of the first component with respect to the second component.

2. The assembly kit of claim 1 wherein the receptacles of the first component comprise holes.

3. The assembly kit of claim 1 wherein the receptacles of the second component comprise wells.

4. The assembly kit of claim 1 wherein the first turbocharger component flange comprises a flange of a center housing.

5. The assembly kit of claim 1 wherein the second turbocharger component flange comprises a flange of a turbine housing or a compressor housing.

6. The assembly kit of claim 1 wherein the piece comprises a pin.

7. The assembly kit of claim 1 comprising an information table that comprises rotational orientation angles and receptacle locations to achieve each of the rotational orientation angles.

8. The assembly kit of claim 7 wherein the information table comprises information stored in a processor-readable medium.

9. The assembly kit of claim 1 wherein the first interval angle exceeds the second interval angle.

10. The assembly kit of claim 1 wherein the first component includes fewer receptacles than the second component.

11. The assembly kit of claim 10 wherein the first interval angle exceeds the second interval angle.

12. The assembly kit of claim 1 configured for incremental rotational orientation angles of less than approximately ten degrees.

13. The assembly kit of claim 1 configured for rotational orientation angles ranging from zero degrees to three-hundred and fifty-nine degrees.

14. The assembly kit of claim 1 further comprising a clamp to axially locate the first and the second components.

15. An assembly comprising:

a center housing that comprises a joint surface with a first number of receptacles;

an end housing that comprises an opening configured for gas flow and a joint surface with a second number of receptacles that differs from the first number of receptacles; and a piece selectively positioned at least partially in one of the receptacles of the center housing and at least partially in one of the receptacles of the end housing to constrain rotation of the end housing opening with respect to the center housing.

16. The assembly of claim 15 further comprising a conduit connected to the opening of the end housing.

17. The assembly of claim 16 wherein the constraint of rotation avoids wear of the conduit.

18. The assembly of claim 15 wherein the conduit comprises a bellows.

* * * * *